US005450626A

United States Patent [19]

Sorrels

[11] Patent Number: 5,450,626

[45] Date of Patent: Sep. 19, 1995

[54] PROTECTIVE GUARD

[76] Inventor: M. Kevin Sorrels, 10102 Burgoyne, Houston, Tex. 77042

[21] Appl. No.: 186,816

[22] Filed: Jan. 25, 1994

Related U.S. Application Data

[63] Continuation of Ser. No. 988,717, Dec. 10, 1992, abandoned.

[51] Int. Cl.[6] ..... A41D 13/08

[52] U.S. Cl. ..... 2/21; 2/163

[58] Field of Search ..... 2/21, 16, 163, 161.7; 128/880; 602/22, 5; 132/285, 319, 73

[56] References Cited

U.S. PATENT DOCUMENTS

| | | | |
|---|---|---|---|
| 136,640 | 3/1873 | Bond | 2/21 X |
| 1,316,292 | 9/1919 | Fleming | 2/21 |
| 1,337,957 | 4/1920 | Rasmussan | 2/21 |
| 1,388,618 | 8/1921 | Stein | 2/21 |
| 2,538,889 | 1/1951 | Swarin | 2/21 |
| 3,070,804 | 1/1963 | Parrilla | 2/21 |

FOREIGN PATENT DOCUMENTS

| | | | |
|---|---|---|---|
| 182830 | 2/1936 | Switzerland | 2/21 |

*Primary Examiner*—Clifford D. Crowder
*Assistant Examiner*—Amy B. Vanatta
*Attorney, Agent, or Firm*—The Keeling Law Firm

[57] ABSTRACT

The present invention comprises a protective finger guard having a flexible and puncture resistant construction. The finger guard comprises an elongated tubular member constructed to cover the middle and terminal phalanges of a finger or thumb (from the medial finger joint extending just beyond the fingertip). An indentation is provided in the tubular member at the end adjacent the medial finger joint on the ventral side to allow flexibility and bending the finger at the medial joint. An indentation is provided in the distal end of the tubular member, again on the ventral side, to allow the finger pad to extend therethrough. Hood-like extensions are provided at each end of the tubular member on the dorsal side extending to the end of the finger and to the end of the medial finger joint.

17 Claims, 1 Drawing Sheet

PROTECTIVE GUARD

This is a continuation of copending application serial number 07/988,717 filed on Dec. 10, 1992, now abandoned.

FIELD OF THE INVENTION

This invention relates generally to the field of protective guards for fingers and thumbs for preventing the transmission of blood-borne and other pathogens from the patient to the practitioner during routine medical, dental, and laboratory procedures, such as during hypodermic injections, and more particularly to preventing penetration of the practitioner's skin and tissue of the fingers and thumbs.

BACKGROUND OF THE INVENTION

There is a recognized need to protect medical and dental practitioners from the risk of infection from blood-borne and other pathogens. Inadvertent penetration of the practitioner's skin and tissue by sharps occur from time to time during routine medical, dental, and laboratory procedures. Since human tissue can be easily punctured by needles and other medical instruments, the medical or dental practitioner is subjected to the risk of contamination by such diseases as staphylococcus, hepatitis, and Acquired Immune Deficiency Syndrome (AIDS).

Finger coverings and hand protectors have long been used to help the wearer in carrying out special operations either in work or in sports, and their benefits are well known.

Surgical gloves are used by medical and dental practitioners to lessen the risk of transferring blood-borne and other pathogens during surgical and dental procedures. Surgical gloves, however, do not provide adequate protection from penetration of human tissue by sharps such as hypodermic needles, medical, dental and laboratory instruments, burs, and sharp projections of hard tissue and prostheses.

Adaptation of a suitable finger guard for use by a dentist during intraoral injections and during intraoral operations is complicated by the limited space within a mouth in which to insert fingers and necessary dental instruments, and is further complicated by the need of the dentist to be able to feel or palpate with his fingertips various surfaces within the mouth and the needle or instrument used.

R. Ames, et. al. U.S. Pat. No. 3,228,033 discloses a finger guard adapted to be placed over the fingers of a person for use while pinning garments, particularly diapers, on a baby. The finger guard comprises an elongated hollow body interconnected by side walls with an opening in one end to insert fingers therein. A guard rail is formed around the exterior surface of the finger guard, the finger guard insertable over the index and middle finger. The upper surface and guard rail are of hard material to deflect the point of a pin.

Brewer U.S. Pat. No. 4,689,828 discloses a finger protector for hair stylists' fingers including a wrist band joined by a joining portion to a two-finger protector, the two-finger protector having open ends for the fingers to extend through.

Sullivan, et. al. U.S. Pat. No. 4,858,245 discloses an armored glove finger comprising a rib knit tubular member having an open end and an end closed with a seam. The reinforcement patch and the seamless fabric element are each comprised of high tensile strength yarns. The armored glove finger may be assembled by folding the reinforcement patch over a finger and then inserting the seamless fabric element over the finger.

Pierce U.S. Pat. No. 4,901,372 discloses a barrier surgical glove, cot, or hand covering for protecting surgeons and health care workers including an integral trilaminar construction with continuous inner and outer barrier layers and a central foam layer. The trilaminar construction reduces the risk of a puncture through the glove.

Lyell U.S. Pat. No. 4,985,038 discloses a needle stop surgical instrument comprising a finger housing, a needle receiving space, and a handle. The finger housing receives a finger, the needle receiving space receives and guides a needle. The handle is grippable between the remaining fingers of the hand and the palm of the hand to allow maneuvering.

Beck U.S. Pat. No. 5,070,543 discloses surgical needle protection including surgical gloves having added thereto an impervious protective pad to a selected area of the surgical gloves, including the palm and fingertips.

Various other finger protection means are identified by reference in the foregoing patents, which references may be relevant to the subject invention.

In addition to the apparatus described, surgeons and medical practitioners sometimes attempt to reduce the risk of punctures by sharps and contamination by blood-borne and other pathogens by wearing two conventional surgeons' gloves on each hand.

The foregoing apparatus and methods are not entirely successful because increased thickness reduces the tactile sensation felt by the medical practitioner. In order to control the patient during a medical or dental procedure, it is often necessary to maintain tactile sensation to reduce the risk of inadvertent sharps penetration. It is also necessary to maintain tactile sensation during laboratory procedures and while handling contaminated sharps.

SUMMARY OF THE INVENTION

It is an object of the present invention to provide a sheath for protecting the fingers and thumbs of medical and dental practitioners from skin and tissue punctures and contamination by blood-borne and other pathogens during hypodermic injections, administration of intravenous needles, transfer of blood samples, and other medical and dental procedures.

It is a further object of this invention to provide protection for the fingers and thumbs of medical and dental practitioners from infection resulting from cuts or scrapes.

It is a further object of this invention to provide a finger guard for medical and dental practitioners that provides protection while allowing free movement of the protected finger.

It is a further object of this invention to provide a finger guard for medical and dental professionals that is easily inserted and removed.

It is a further object of this invention to provide a finger guard for medical and dental professionals that may be re-used on the same patient.

It is a further object of this invention to provide a finger guard for medical and dental practitioners which is readily disposable.

It is a further object of the present invention to provide a finger guard for medical and dental practitioners which may be used with surgical gloves.

These and other objects are accomplished by the subject invention.

The present invention comprises a protective finger guard having a flexible and puncture resistant construction. The finger guard comprises an elongated tubular member constructed to cover the middle and terminal phalanges of a finger or thumb (from the medial finger joint extending just beyond the fingertip). An indentation is provided in the tubular member at the end adjacent the medial finger joint on the ventral side to allow flexibility and bending the finger at the medial joint. An indentation is provided in the distal end of the tubular member, again on the ventral side, to allow the finger pad to extend therethrough. Hood-like extensions are provided at each end of the tubular member on the dorsal side extending to the end of the finger and to the end of the medial finger joint.

The tubular member is constructed of impermeable, flexible material. An embodiment of the tubular member includes a member constructed of a flexible material on the ventral side and a relatively harder material provided on the dorsal side.

DESCRIPTION OF THE PREFERRED EMBODIMENT

Figure 1:
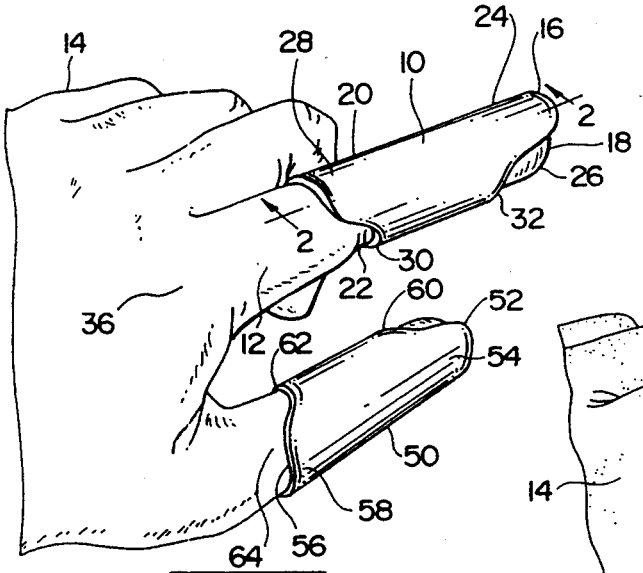
FIG. 1 depicts an isometric view of a hand having inserted on the index finger the finger guard of the present invention and having inserted on the thumb the finger guard of the present invention.

Referring to FIG. 1, the finger guard 10 of the present invention is depicted inserted on the index finger 12 of hand 14. Thumb guard 50 is depicted inserted on thumb 64 of hand 14.

Finger guard 10 comprises an elongated tubular member extending generally from the medial joint 22 of finger 12 to the end 18 of finger 12.

An outer hood 24 is provided on the dorsal side of finger guard 10 extending to the end 18 of finger 12, such outer hood 24 extending the length of the middle and terminal phalanges of the finger 12.

As used herein, dorsal in relation to a finger means that portion of the finger opposite the palm of the hand and ventral means the palmar side or the portion of the finger adjacent the palm when a fist is formed. Dorsal and ventral terminology is applied in similar manner to the finger guard 10 as installed on the finger 12 in the preferred embodiment, the outer hoods 24 and 28 being located on the dorsal side of finger 12.

End 16 of finger guard 10 is irregularly shaped, extending obliquely and at varying angles in relation to the central axis of finger guard 10 from an outer extension at the end of outer hood 24 inwardly in relation to the hand 14. An indentation 32 is provided on the ventral side of the finger guard 10 to expose the finger pad 26 of finger 12.

The indentation 32 of end 16 extends around the finger pad 26 of finger 12, the innermost portion of the indentation 32 being at or just in front of the distal joint 34 of the finger 12.

Figure 2:
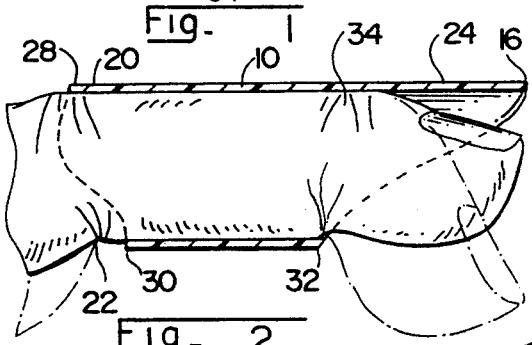
FIG. 2 depicts a medial side view of the finger guard of the present invention along lines 2—2 of FIG. 1.

Outer hood 28 of the opposing end 20 of the finger guard 10 extends beyond the medial joint 22 of finger 12. Referring to FIG. 2, the end 20 includes an outwardly extending outer hood 28 and an inwardly extending indentation 30. Outer hood 28 is located on the dorsal side of the finger guard 10 as is outer hood 24. Likewise, indentation 30 is positioned on the ventral side of the finger guard 10 as is indentation 32.

In the preferred embodiment the distance between the innermost portion of end 16 (at indentation 32) and the innermost portion of end 20 (at indentation 30) corresponds generally to the length of the middle phalange or distance between the medial joint 22 of finger 12 and the distal joint 34 of finger 12.

The distance between the outermost extension of end 16 (at the end of outer hood 24), and the outermost extension of end 20 (at the end of outer hood 28) corresponds generally to the length of the middle and terminal phalanges or the distance between the outermost extension of the finger end 18 and the dorsal surface of the finger 12 extending beyond the medial joint 22.

Referring to FIG. 2, a side view along lines 2—2 of FIG. 1 is depicted. An important feature of the finger guard 10 is that the finger guard 10 is so constructed in relation to finger 12 as to allow the finger 12 the flexibility to bend at distal joint 34 and at medial joint 22.

Still referring to FIG. 2, the outer hood 24 at end 16 provides a protective cover for finger 12 along the dorsal surface of finger 12. Outer hood 28 provides protection at medial joint 22 of the dorsal surface of finger 12, the body of finger guard 10 providing protection along intermediate dorsal surfaces.

Still referring to FIG. 2, the distance between the innermost extensions of end 16 and end 20 (indentation 32 to indentation 30) is so sized in relation to the distance between medial joint 22 and distal joint 34 of the middle phalange as to allow bending of finger 12 at such joints.

Figure 3:
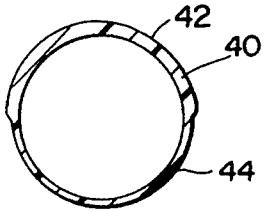
FIG. 3 depicts a first end view of the subject invention.
Figure 4:
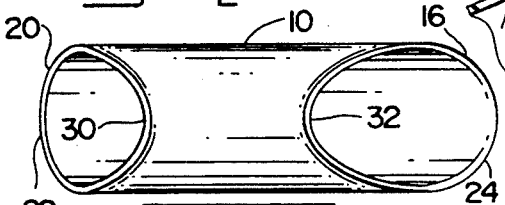
FIG. 4 depicts a bottom view of the subject invention.

Referring to FIG. 3, a cross-sectional view of the wall 40 of the finger guard 10 is depicted. As depicted in FIG. 4, the dorsal segment 42 of the wall 40 of the finger guard 10 is relatively thicker than the ventral segment 44 of wall 40. The increased thickness of the dorsal segment 42 of wall 40 in relation to the ventral segment 44 of wall 40 provides for improved resistance to puncture of the dorsal segment 42 while providing for relatively greater flexibility of the ventral segment 44 of wall 40. In the embodiment shown, the dorsal segment 42 extends one-half of the circumference of wall 40. The circumferential extension of dorsal segment 42 may be varied to extend a greater or lesser distance around the circumference of the wall 40.

Still referring to FIG. 3, the embodiment depicted provides increased resistance to puncture or tearing along dorsal segment 42 due to increased thickness of material. In the preferred embodiment the dorsal segment 42 is constructed of a material composition relatively harder than the material composition of the ventral segment 44 to provide relatively greater protection without the necessity of providing increased thickness.

Referring to FIG. 4, a bottom view of the finger guard 10 of the present invention is depicted. The outer hood 24 and indentation 32 are provided at end 16 of the finger guard 10, the outer edges of outer hood 24 and indentation 32 defining end 16 of finger guard 10, and from the bottom view depicted, defining such end 16 as a generally oval structure. Still referring to FIG. 4, the outer edge of outer hood 28 and the inner edge of indentation 30 define end 20 of finger guard 10. It will be noted from FIG. 4 that outer hood 24 extends outwardly a relatively greater distance from finger guard 10 than does outer hood 28.

A preferred material of construction of the finger guard 10 is polyvinylchloride, such material having a range of flexibility to allow it to be inserted on a finger within a range of finger diameters and providing sufficient flexibility to allow bending of the finger, the said polyvinylchloride material being nontoxic and inert, and being impermeable to liquids, while being of sufficient strength as to resist punctures and tears from sharp objects.

It is desirable to construct the dorsal segment 42 of wall 40 of a material formulation differing from the ventral segment 44 of wall 40, the dorsal segment 42 being relatively harder than the ventral segment 44. Current known plastic extrusion technology allows bonding of similar polyvinylchloride materials during the plastic extrusion process.

Referring again to FIG. 1, a thumb guard 50 of the present invention is depicted. Thumb guard 50 includes a hooded portion 54 at end 52, and a second hooded portion 58 at end 56. Thumb guard 50 further includes an indentation 60 at end 52, and an indentation 62 at end 56. Thumb guard 50 is constructed like finger guard 10, the only differences of consequence being that thumb guard 50 has a relatively wider diameter to account for the differential diameter of thumb 64 in relation to finger 12, and a shorter length to account for the differential length of the middle phalange of thumb 64 in relation to the corresponding middle phalange of finger 12.

Figure 5:
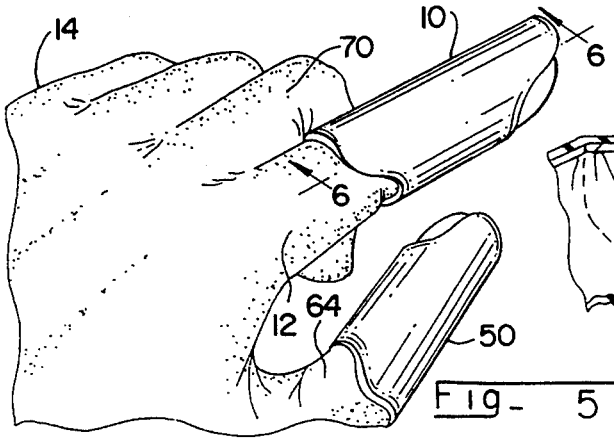
FIG. 5 depicts an isometric view of a human hand containing thereon a surgical glove with the finger guard of the present invention exterior of the surgical glove.

Referring now to FIG. 5, a finger guard 10 of the present invention and the thumb guard 50 of the present invention are shown installed on hand 14, such finger guard 10 and thumb guard 50 being installed over surgical glove 70 inserted on hand 14. As depicted in FIG. 5, finger guard 10 and thumb guard 50 of the present invention may be readily installed on and removed from finger 12 and thumb 64 respectfully after the practitioner dons the surgical glove 70.

Figure 6:
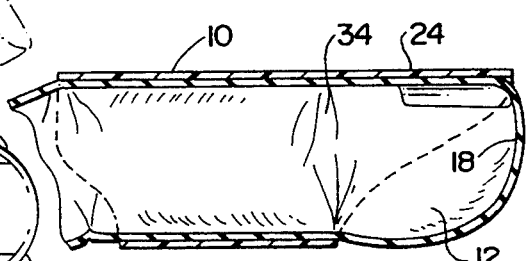
FIG. 6 depicts a partial cross-sectional view of FIG. 5 along lines 6—6.

Referring now to FIG. 6, a partial cross-sectional view of FIG. 5 along line 6—6 is depicted. It may be seen from FIG. 6 that the finger guard 10 is inserted on finger 12 outside of surgical glove 70, surgical glove 70 having been previously installed on hand 14.

Figure 7:
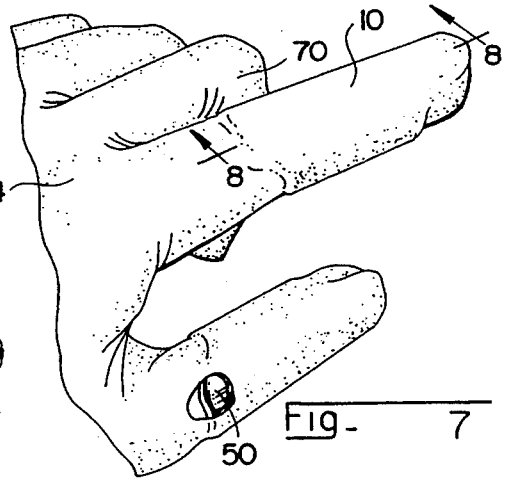
FIG. 7 depicts a human hand having a surgical glove with the finger guard of the present invention located inside the surgical glove.

Referring now to FIG. 7, the finger guard 10 of the present invention and the thumb guard 50 of the present invention are depicted installed directly on the hand 14 with surgical glove 70 installed thereafter thereby covering finger guard 10 and thumb guard 50.

Figure 8:
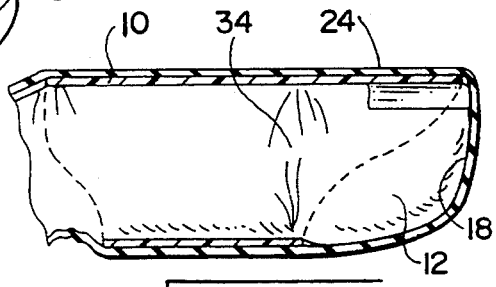
FIG. 8 depicts a partial cross-sectional view of FIG. 6 along lines 8—8.

Referring now to FIG. 8, a partial cross-sectional view of FIG. 6 along line 8—8 is depicted. It may be seen from FIG. 8 that the finger guard 10 is inserted on finger 12, as depicted in FIG. 1, with surgical glove 70 inserted over finger guard 10 and hand 14 thereby providing a protective sheath around finger 12 and finger guard 10. The flexibility of surgical gloves allows the end 18 of finger 12 to be bent at the distal joint 34 even though the finger guard 10 and particularly the outer hood 24 of finger guard 10 resist bending movement.

While the construction of the finger guard 10 and the thumb guard 50 and particularly the size of finger guard 10 and thumb guard 50 have been discussed in relation to the dimensions of finger 12 and thumb 64, the inherent flexibility of polyvinylchloride, the preferred material of construction, allows some deviation from exact dimensions of the finger 12 and thumb 64 without inhibiting the proper functioning of the subject invention. The finger guard 10 and thumb guard 50, when applied to the multitude of applications available, are constructed of various sizes to conform to various finger and thumb dimensions. In this respect, the preferred embodiments of finger guard 10 and thumb guard 50 comprise a variety of preselected sizes, such preselected sizes being constructed to fit a range of finger sizes and thumb sizes respectively.

OPERATION

The operation of the present invention is inherently depicted by FIGS. 1 through 7. The finger guard 10 and thumb guard 50 of the present invention are appropriately used by medical and dental practitioners during medical, dental, and laboratory procedures to prevent inadvertent penetration of the practitioner's skin or tissue by sharps. The finger guard 10 is inserted over finger 12 with the relatively long side having outer hood 24 and outer hood 28 along the dorsal surface of the finger 12. Likewise, thumb guard 50 is inserted over thumb 64 with the outer hood 54 and the outer hood 58 located along the dorsal surface of the thumb 50. The indentations 30 and 32 provided in the finger guard 10 and the indentations 60 and 62 provided in the thumb guard 50 allow the finger pad 26 and thumb pad 68 a full range of freedom to palpate the skin where the injection is to be made and to otherwise provide full textile communication of the thumb 64 and finger 12 with the skin of the patient.

As previously noted, the finger guard 10 and thumb guard 50 may be worn within surgical glove 70 or exterior of surgical glove 70, whichever is more convenient. The simplicity of construction of finger guard 10 and thumb guard 50 allow finger guard 10 and thumb guard 50 to be disposed after a single use or to be reused on an individual patient.

The finger guard 10 may be rotated on finger 12 to protect ventral, lateral or medial portions of the finger 12. By way of example, a practitioner cleaning teeth could rest the protected fingertip on teeth and manipulate sharp instruments such as a scaler in close proximity to the protected finger.

While this invention has been described fully and completely with special emphasis on a single preferred embodiment, it should be understood that within the scope of the appended claims, the invention may be practiced otherwise than as specifically described herein.

I claim:

1. A finger guard for use by medical and dental practitioners for protecting a finger or thumb while performing injections and other procedures involving sharp objects comprising:

a body comprising a generally tubular member removably disposable on said finger;

a first dorsal hood extending from a first end of said body;

said first dorsal hood extending to a fingertip and covering a dorsal surface of the finger;

a first ventral indentation in said body at said first end, said first ventral indentation being sized so as to allow a finger pad to extend outwardly thereof in relation to said body;

a second dorsal hood extending from a second distal end of said body;

said second dorsal hood extending over the dorsal surface of the medial joint of the finger;

a second ventral indentation provided in the second end of said body, said second ventral indentation being sized so as to generally conform to the ventral surface of the finger at said medial joint;

a dorsal segment of said body, the finger hood and the second hood constructed relatively thicker than a ventral segment of the body;

the body, the first hood and the second hood constructed of a flexible, resilient material impermeable to liquids, said body adapted to said finger for continuous surface-to-surface contact with said finger;

the dorsal segment of the body, the first hood and the second hood covering the dorsal surface of the finger from the medial joint to the fingertip;

the ventral segment of the body covering the ventral surface of the middle phalange of the finger;

said body, while disposed on the finger, in continuous surface-to-surface contact with the entire dorsal surface and the entire ventral surface of the middle phalange of the finger;

whereby the said finger guard provides protection for the dorsal surface of the finger from the medial joint to the fingertip and provides protection for the ventral surface of the finger from the medial joint to the finger pad while allowing bending of the finger at the medical joint, bending of the finger at the distal joint and contacting of the fingertip with a patient or an instrument.

2. The finger guard according to claim 1 wherein: the tubular member is constructed of polyvinylchloride.

3. The apparatus according to claim 2 wherein the body resiliently adapts to accommodate a range of finger diameters.

4. The apparatus according to claim 1 wherein said body is flexible in response to movement of said finger.

5. The apparatus according to claim 1 wherein the body is rotatable about the finger to protect a side or ventral finger surface.

6. The apparatus according to claim 1 wherein the finger guard may be worn within a surgical glove without damaging said surgical glove.

7. The apparatus as claimed in claim 3 wherein the body comprises a tubular member having a continuous, seamless cross-section.

8. The apparatus according to claim 4 wherein the finger guard is sized such that, when disposed upon the finger, the finger guard prevents liquid penetration beneath the finger guard and liquid contact with the portion of the finger covered by the finger guard.

9. A finger guard for use by medical and dental practitioners for protecting a finger or thumb while performing injections and other procedure involving sharp objects comprising:

a body comprising a generally tubular member removably disposable on said finger;

a first dorsal hood extending from a first end of said body;

said first dorsal hood extending to a fingertip and covering a dorsal surface of the finger;

a first ventral indentation in said body at said first end, said first ventral indentation being sized so as to allow a finger pad to extend outwardly thereof in relation to said body;

a second dorsal hood extending from a second distal end of said body;

said second dorsal hood extending over the dorsal surface of the medial joint of the finger;

a second ventral indentation provided in the second end of said body, said second ventral indentation being sized so as to generally conform to the ventral surface of the finger at said medial joint;

a dorsal segment of said body, the first hood and the second hood constructed of a material that is relatively harder than a ventral segment of the body;

the body, the first hood and the second hood constructed of the flexible, resilient material impermeable to liquids, said body adaptable to said finger for continuous surface-to-surface contact with said finger;

the dorsal segment of the body, the first hood and the second hood covering the dorsal surface of the finger from the medial joint to the fingertip;

the ventral segment of the body converting the ventral surface of the middle phalange of the finger;

said body, while disposed on the finger, in continuous surface-to-surface contact with the entire dorsal surface and the entire ventral surface of the middle phalange of the finger;

whereby the said finger guard provides protection for the dorsal surface of the finger from the medial joint to the fingertip and provides protection for the ventral surface of the finger from the medial joint to the finger pad while allowing bending of the finger at the medial joint, bending of the finger at the distal joint and contacting of the fingertip with a patient or an instrument.

10. The apparatus according to claim 9 wherein the body resiliently adapts to accommodate a range of finger diameters.

11. The apparatus according to claim 10 wherein said body is flexible in response to movement of said finger.

12. The apparatus according to claim 9 wherein the body is rotatable about the finger to protect a side of ventral finger surface.

13. The apparatus according to claim 12 wherein the tubular member is constructed of polyvinylchloride.

14. The apparatus according to claim 6 wherein the finger guard may be worn within a surgical glove without damaging said surgical glove.

15. The apparatus as claimed in claim 8 wherein the body comprises a tubular member having a continuous, seamless cross-section.

16. The apparatus according to claim 9 wherein the finger guard is sized such that, when disposed upon the finger, the finger guard prevents liquid penetration beneath the finger guard and liquid contact with the portion of the finger covered by the finger guard.

17. A finger guard for use by medical and dental practitioners for protecting a finger or thumb while performing injections and other procedures involving sharp objects comprising:

a body comprising a generally tubular member removably disposable on said finger;

a first dorsal hood extending from a first end of said body;

said first dorsal hood extending to a fingertip and covering a dorsal surface of the finger;

a first ventral indentation in said body at said first end, said first ventral indentation being sized so as to allow a finger pad to extend outwardly thereof in relation to said body;

a second dorsal hood extending from a second distal end of said body;

said second dorsal hood extending over the dorsal surface of the medial joint of the finger;

a second ventral indentation provided in the second end of said body, said second ventral indentation being sized so as to generally conform to the ventral surface of the finger at said medial joint;

a dorsal segment of said body, the first hood and the second hood constructed relatively thicker than a ventral segment of the body;

the body, the first hood and the second hood constructed of a flexible, resilient material impermeable to liquids, said body adaptable to said finger for continuous surface-to-surface contact with said finger;

the dorsal segment of the body, the first hood and the second hood covering the dorsal surface of the finger from the medial joint to the fingertip;

the ventral segment of the body covering the ventral surface of the middle phalange of the finger;

said body, while disposed on the finger, in continuous surface-to-surface contact with the entire dorsal surface and the entire ventral surface of the middle phalange of the finger;

the finger guard may be worn within a surgical glove without damaging said surgical glove;

the body is adaptable to a range of finger diameters;

said body is flexible in response to movement of said finger;

the finger guard is sized such that, when disposed upon the finger, the finger guard will not permit liquid to penetrate beneath the finger guard and contact the portion of the finger covered by the finger guard; and whereby the said finger guard provides protection for the dorsal surface of the finger from the medial joint to the fingertip and provides protection for the ventral surface of the finger from the medial joint to the finger pad while allowing bending of the finger at the medial joint, bending of the finger at the distal joint and contacting of the fingertip with a patient or an instrument.

* * * * *